US009892897B2

(12) United States Patent
Gill et al.

(10) Patent No.: US 9,892,897 B2
(45) Date of Patent: Feb. 13, 2018

(54) METHOD OF CONTROLLING A DC POWER SUPPLY

(71) Applicant: SHIMADZU CORPORATION, Kyoto (JP)

(72) Inventors: Matthew Gill, Manchester (GB); Stuart Harley, Manchester (GB); Jeff Chadbourne, Manchester (GB)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 93 days.

(21) Appl. No.: 14/984,053

(22) Filed: Dec. 30, 2015

(65) Prior Publication Data

US 2016/0217989 A1 Jul. 28, 2016

(30) Foreign Application Priority Data

Jan. 27, 2015 (GB) ..... 1501300.6

(51) Int. Cl.
*H01J 49/26* (2006.01)
*H01J 49/02* (2006.01)

(52) U.S. Cl.
CPC ..... *H01J 49/022* (2013.01)

(58) Field of Classification Search
USPC ..... 323/212, 234, 299, 304, 318; 250/281, 250/282, 283, 492.1, 492.2, 492.3
See application file for complete search history.

(56) References Cited

U.S. PATENT DOCUMENTS 8,030,613 B2 10/2011 Makarov et al.
8,759,759 B2 6/2014 Ding et al.
(Continued)

FOREIGN PATENT DOCUMENTS

GB 2437829 A 11/2007
JP 2002-502085 A 1/2002
(Continued)

OTHER PUBLICATIONS

Communication dated Jul. 8, 2016 from the European Patent Office in counterpart Application No. 15198463.0.
(Continued)

*Primary Examiner* — Nicole Ippolito
(74) *Attorney, Agent, or Firm* — Sughrue Mion, PLLC

(57) ABSTRACT

A method of controlling a DC power supply to change a DC offset voltage applied to a component for manipulating charged particles. The method includes, whilst an AC voltage waveform is being applied to the component: controlling the DC power supply to produce an initial DC offset voltage that is applied to the component via a link that causes the DC offset voltage at the component to lag behind the DC offset voltage produced by the DC power supply when the DC offset voltage produced by the DC power supply is changed; then controlling the DC power supply to produce an overdrive DC offset voltage that is applied to the component via the link for a predetermined period of time; then controlling the DC power supply to produce a target DC offset voltage that is applied to the component via the link, wherein the target DC offset voltage is between the initial DC offset voltage and the overdrive DC offset voltage.

10 Claims, 19 Drawing Sheets

(56) References Cited

U.S. PATENT DOCUMENTS

| | | | | |
|---|---|---|---|---|
| 2009/0008543 | A1* | 1/2009 | Reinhold | H01J 49/427 250/282 |
| 2009/0127456 | A1* | 5/2009 | Makarov | H01J 49/022 250/290 |
| 2010/0072362 | A1 | 3/2010 | Giles et al. | |
| 2010/0084552 | A1* | 4/2010 | Kawana | H01J 49/0077 250/288 |
| 2012/0248307 | A1* | 10/2012 | Ding | H01J 49/423 250/293 |
| 2016/0118235 | A1 | 4/2016 | Fujita | |

FOREIGN PATENT DOCUMENTS

| | | | |
|---|---|---|---|
| JP | 2008-503864 | A | 2/2008 |
| JP | 2012-34496 | A | 2/2012 |
| JP | 2014-112570 | A | 6/2014 |
| WO | 2007/131146 | A2 | 11/2007 |
| WO | 2011/125399 | A1 | 10/2011 |
| WO | 2014/181396 | A1 | 11/2014 |

OTHER PUBLICATIONS

Von Wolfgang Paul et al., "Z. Naturforschg", 1953, 8a, pp. 448-450.
Horowitz et al., "The Art of Electronics", 1989, Second Edition, pp. 23-24.
Communication dated Jan. 24, 2017 from the Japanese Patent Office in application No. 2015-247566.

* cited by examiner

METHOD OF CONTROLLING A DC POWER SUPPLY

FIELD OF THE INVENTION

This invention relates to a method of controlling a DC power supply to change a DC offset voltage applied to a component for manipulating charged particles.

BACKGROUND

In mass spectrometers it is common to employ ion optical components which have an alternating current ("AC") voltage waveform, e.g. a radiofrequency ("RF") voltage waveform, applied thereto, e.g. for the purpose of containing charged particles. Examples of ion optical components include multipole devices (such as quadrupole, hexapoles, octapoles etc), 3D ion traps, stacked ring ion guides, mass filters, ion funnels, linear ions traps, ion guides. Other examples exist. Frequently, several ion optical components might be employed in a device, such as a mass spectrometer, in combination, where they might serve different purposes. For example, an ion funnel might be employed to capture ions at the inlet of a mass spectrometer, before the ions are transferred into a hexapole and then onwards into a mass filter before being detected.

Often, ions are transferred from one ion optical component to another (or within one ion optical component) by using DC offset voltages, e.g. to create a DC gradient. For example, a DC gradient going from a more positive potential to a more negative potential would tend to move positive ions from the region of more positive potential to the region of more negative potential. Negative ions would experience the reverse force and would tend to be moved from the region of more negative potential to the region of more positive potential. An example of such a DC offset scheme is shown in FIG. 1. Here, a higher DC offset voltage is applied to the first ion optical element 1. The DC offset voltage profile 11 varies in magnitude along the length. A DC offset voltage profile such as that shown in FIG. 1 might be used to transfer positively charged ions into the fourth ion optical component 7 and trap them there (assuming adequate attention is paid to cooling of the ions to reduce their translational energy).

In some cases, several ion optical devices might have the same AC voltage waveform applied, but might be required to have different DC offset voltages. One example of such a situation might be a segmented ion guide device, where several segments each have the same applied AC voltage waveform, but have different DC offset potentials.

The inventors have observed that when changing a DC offset voltage produced at a DC power supply from an initial DC offset voltage to a target DC offset voltage, it can take some time for a corresponding change in DC offset voltage to take place at a component to which the DC offset voltage is applied. The inventors believe it may be desirable for the change in DC offset voltage at the component to take place more quickly (as might be useful in cases where time is critical) and/or to take place at a preferred time (as might be useful where it is desired for changes in DC offset voltages at multiple components to take place in the same time window).

The present invention has been devised in light of the above considerations.

By way of background:

Paul and Steinwedel in 1953 (Z. Naturforsch, 1953, 8a, 448 describes a quadrupole mass analyser.

Horowitz and Hill, 1989, "The Art of Electronics", Second edition, pages 23-24 describes the physical response of an RC network.

U.S. Pat. No. 8,759,759B2 discloses a linear ion trap mass analyzer comprised by multiple columnar electrodes. FIG. 5 of this document provides a schematic of an RC coupling network. This figure is referenced in paragraph [0047] where the circuit of FIG. 5 is described as being "used to superimpose [a] high frequency voltage component and [a] field-adjustable DC voltage component"

U.S. Pat. No. 8,030,613B2 discloses a radio frequency (RF) power supply in a mass spectrometer. FIG. 3 of this document shows a schematic of a circuit used to apply a DC offset by way of a centre tapped transformer.

SUMMARY OF THE INVENTION

In a first aspect, the invention may provide:

A method of controlling a DC power supply to change a DC offset voltage applied to a component for manipulating charged particles, wherein the method includes, whilst an AC voltage waveform is being applied to the component:

controlling the DC power supply to produce an initial DC offset voltage that is applied to the component via a link that causes the DC offset voltage at the component to lag behind the DC offset voltage produced by the DC power supply when the DC offset voltage produced by the DC power supply is changed; then controlling the DC power supply to produce an overdrive DC offset voltage that is applied to the component via the link for a predetermined period of time; then controlling the DC power supply to produce a target DC offset voltage that is applied to the component via the link, wherein the target DC offset voltage is between the initial DC offset voltage and the overdrive DC offset voltage.

In this way, the DC offset voltage at the component is able to reach the target DC offset voltage more quickly, since the overdrive DC offset voltage produced by the DC power supply is able to cause the DC offset voltage at the component to move towards the target DC offset voltage more quickly than would have been the case had the DC power supply been controlled to produce the target DC offset voltage without first producing the overdrive DC offset voltage, see e.g. FIG. 7.

There is preferably little or no time gap between the steps of controlling the DC power supply to produce the initial DC offset voltage, the overdrive DC offset voltage, and the target DC offset voltage. To the extent that there is a time gap, this time gap is preferably insignificant when compared to the time taken for the DC offset voltage at the component to settle at a DC offset voltage produced by the DC power supply following a change in the voltage produced by the DC power supply. For example, this might be achieved by having a time gap that is less than one microsecond.

For the avoidance of any doubt, any of the initial voltage, target voltage and/or overdrive voltage may be positive, negative or zero relative to a reference voltage (e.g. ground), though in the examples discussed below the initial voltage produced by the DC power supply is assumed to be zero for illustrative purposes.

Note that the voltage at the component (i.e. as "seen" or experienced by the component) will include both an AC voltage caused by the AC voltage waveform applied to the component (e.g. as produced by an AC power supply), as well as a DC offset voltage caused by the DC offset voltage produced by the DC power supply.

However, it is to be appreciated that the DC offset voltage at the component (i.e. as "seen" or experienced by the component) is not necessarily the same as the DC offset voltage produced by the DC power supply. This is because the link causes the DC offset voltage at the component to lag behind the DC offset voltage produced by the DC power supply, when the DC offset voltage produced by the DC power supply is changed, see e.g. Equation 4 and the corresponding discussion below.

Preferably, the method includes choosing (e.g. calculating) the predetermined period of time such that the DC power supply starts producing the target DC offset voltage (that is applied to the component via the link) when the DC offset voltage at the component is at, or is within a predetermined threshold of, the target DC offset voltage. Here, the predetermined threshold may be 50%, more preferably 10%, more preferably 5%, more preferably 1%, of the magnitude of the difference between the initial voltage and the target voltage. In this context, 5% is a preferred threshold.

In this way, the overdrive DC offset voltage can be used to move the DC offset voltage at the component the majority of the way towards the target DC offset voltage.

In some embodiments, the overdrive DC offset voltage is, or is within a predetermined threshold of, a maximum output voltage of the DC power supply. Here, the predetermined threshold may be 90%, more preferably 95%, more preferably 99%, of a maximum output voltage of the DC power supply. In this context, 90% is a preferred threshold.

In this way, the overdrive DC offset voltage can help to move the DC offset voltage at the component towards the target DC offset voltage as quickly as possible.

Note that the DC power supply may have a positive maximum output voltage and/or a negative maximum output voltage (i.e. so there may be two maximum voltages for a given DC power supply).

In some embodiments, the method may include choosing (e.g. calculating) the overdrive DC offset voltage such that the DC offset voltage at the component is at, or is within a predetermined threshold of, the target voltage at the end of the predetermined period of time. Here, the predetermined threshold may be 50%, more preferably 10%, more preferably 5%, more preferably 1%, of the magnitude of the difference between the initial voltage and the target voltage. In this context, 5% is a preferred threshold.

In this way, the method can be used so that the DC offset voltage at the component is at the target DC offset voltage (within the predetermined threshold, if specified) at the end of the predetermined period of time. This is particularly useful if it is desirable for the voltage at each of a plurality of components to reach a respective target DC offset voltage at the end of the same predetermined period of time (see below).

In such embodiments, the method may include a step of a user selecting the predetermined period of time.

In such embodiments, the method may include determining whether the chosen (e.g. calculated) overdrive DC offset voltage is greater than a maximum output voltage of the DC power supply.

In some embodiments, if the chosen (e.g. calculated) overdrive DC offset voltage is determined to be greater than a maximum output voltage of the DC power supply, then the overdrive DC offset voltage (applied to the component via the link for the predetermined period of time) may be selected as, or within a predetermined threshold of, the maximum output voltage of the DC power supply.

In some embodiments, if the chosen (e.g. calculated) overdrive DC offset voltage is determined to be greater than a maximum output voltage of the DC power supply, then the method may include issuing a warning notification to a user indicating that that the target DC offset voltage cannot be achieved (at the component) within the predetermined period of time.

In some embodiments, there may be a plurality of DC power supplies, with each DC power supply corresponding to a respective component for manipulating charged particles, with the method being performed, respectively, for each DC power supply. In these embodiments, the same AC voltage waveform may be applied to each of the components.

Accordingly, there may be provided:

A method of controlling a plurality of DC power supplies to change a respective DC offset voltage applied to each of a plurality of components for manipulating charged particles, wherein each DC power supply corresponds to a respective component, and wherein the method includes, whilst the same AC voltage waveform is being applied to each of the components:

for each DC power supply, respectively:

controlling the DC power supply to produce an initial DC offset voltage that is applied to the component corresponding to the DC power supply via a link that causes the DC offset voltage at the component to lag behind the DC offset voltage produced by the DC power supply when the DC offset voltage produced by the DC power supply is changed; then controlling the DC power supply to produce an overdrive DC offset voltage that is applied to the component corresponding to the DC power supply via the link for a predetermined period of time; then, after the predetermined period of time has elapsed controlling the DC power supply to produce a target DC offset voltage that is applied to the component corresponding to the DC power supply via the link, wherein the target DC offset voltage is between the initial DC offset voltage and the overdrive DC offset voltage.

In such embodiments, any of the features described above may be implemented, respectively, for each DC power supply.

Note that each DC offset voltage may be applied to a respective component via a respective link.

In such embodiments, it is particularly preferred that, the method includes, for each DC power supply, respectively: choosing (e.g. calculating) the overdrive DC offset voltage such that the DC offset voltage at the component corresponding to the DC power supply is at, or is within a predetermined threshold of, the target voltage at the end of the same predetermined period of time.

In this way, the voltage at each of the plurality of components can be made to reach a respective target DC offset voltage at the end of the same predetermined period of time, even if the DC power supplies are connected to their ion optical components via links having different properties (e.g. RC networks having different resistances and/or capacitances). Note that the target DC offset voltage for each component could be different or the same. Note also that even if the target DC offset voltage for each component is the same, the overdrive DC offset voltage could still be different for each component, e.g. if the link for each component is an RC network including different resistances or capacitances.

The/each DC power supply is preferably a computer controllable DC power supply which has a voltage output which can be changed rapidly under computer control at a set time.

However, in other embodiments, the/each DC power supply may be a composite DC power supply, e.g. incorporating more than one DC power supply such that the composite DC power supply is able to produce different DC voltages.

The/each link is preferably an RC network that includes at least one resistance and at least one capacitance, since an RC network is an example of a link that would cause the DC offset voltage at the component to lag behind the DC offset voltage produced by the DC power supply when the DC offset voltage produced by the DC power supply is changed. However, it would also be possible for the/each link to be an LC network including at least one inductance and at least one capacitance, for example. Or indeed other links that would cause the DC offset voltage at the component to lag behind the DC offset voltage produced by the DC power supply when the DC offset voltage produced by the DC power supply is changed.

The/each component for manipulating charged particles may be an ion optical component, e.g. as may be used in a mass spectrometer (as is the case in the examples discussed below) or as may be used in a device for controlling ions which is not a mass spectrometer (e.g. an ion store). However, this is not a requirement, as the components might be for manipulating charged particles other than ions, e.g. electrons The/each DC power supply and/or the/each component for manipulating charged particles may be included in a mass spectrometer.

The method may include controlling an AC power supply to produce the AC voltage waveform that is applied to the/each component. The AC voltage waveform may be applied to the/each component via the/each link.

The AC voltage waveform may be an RF voltage waveform, which for the purposes of this disclosure can be understood as an AC voltage waveform having a radio frequency.

The AC (e.g. RF) voltage waveform might be sinusoidal in shape, a square wave waveform, or other waveform shapes such as sawtooth etc.

The first aspect of the invention may also provide a controller configured to control an apparatus including a DC power supply to perform any method as set out above.

The controller may include a computer, a control chip (e.g. a PIC or an FPGA), and/or timing circuitry (e.g. formed from RC timing components or similar analogue circuitry).

The apparatus may include: the component for manipulating charged particles, a plurality of DC power supplies; and/or a plurality of the components.

The first aspect of the invention may also provide a computer readable medium having computer-executable instructions configured to cause a computer to control an apparatus including a DC power supply to perform any method as set out above.

The apparatus may include: the component for manipulating charged particles, a plurality of DC power supplies; and/or a plurality of the components.

A second aspect of the present invention may provide a method, a controller or a computer readable medium according to the first aspect of the invention, except that the/each component is not required to be suitable for manipulating charged particles, since the method may find applicability even where the component is not suited for this purpose.

A third aspect of the present invention may provide a method, computer or computer readable medium according to the first aspect of the invention, except that the method is performed without applying an AC voltage waveform to the/each component, since the method could still be used to switch DC voltages even when an AC voltage waveform is not applied to the/each component.

The invention also includes any combination of the aspects and preferred features described except where such a combination is clearly impermissible or expressly avoided.

DETAILED DESCRIPTION

Examples of our proposals are discussed below, with reference to the accompanying drawings in which.

Figure 14:
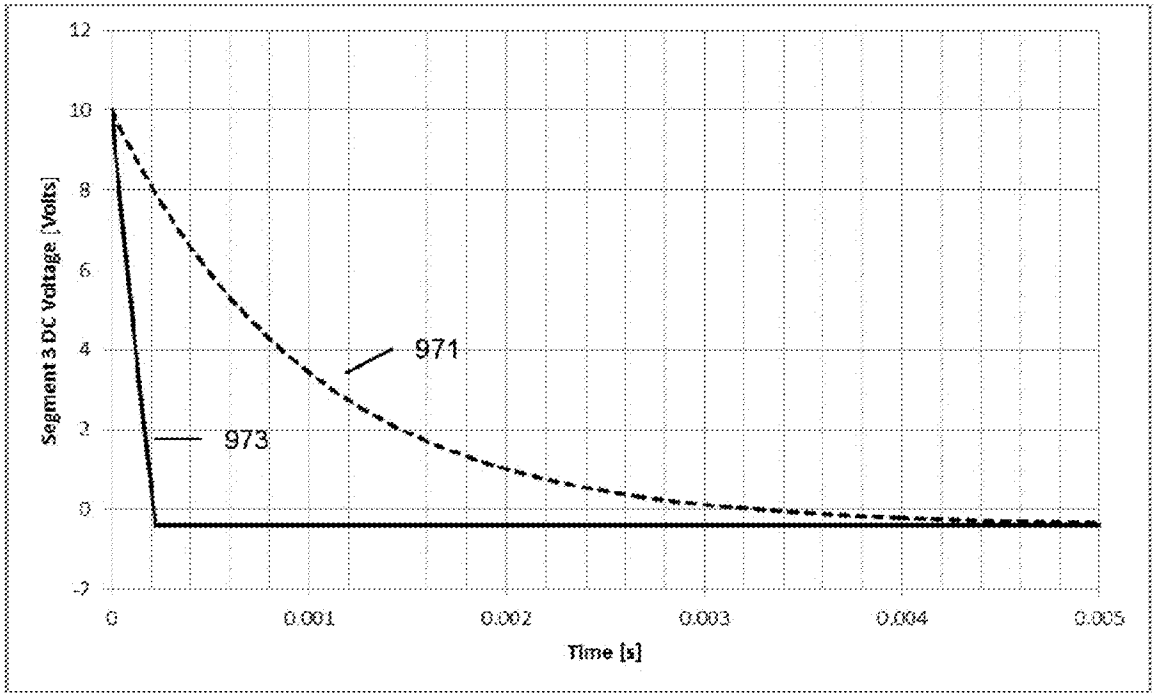

FIG. 14 shows voltage profiles applied to the third ion guide segment in a simulation using the example electrode structure. The dashed line shows the natural RC response when changing the DC offset applied to Segment 3. The solid line shows the DC offset voltage profile when using a preferred method.

Figure 15:
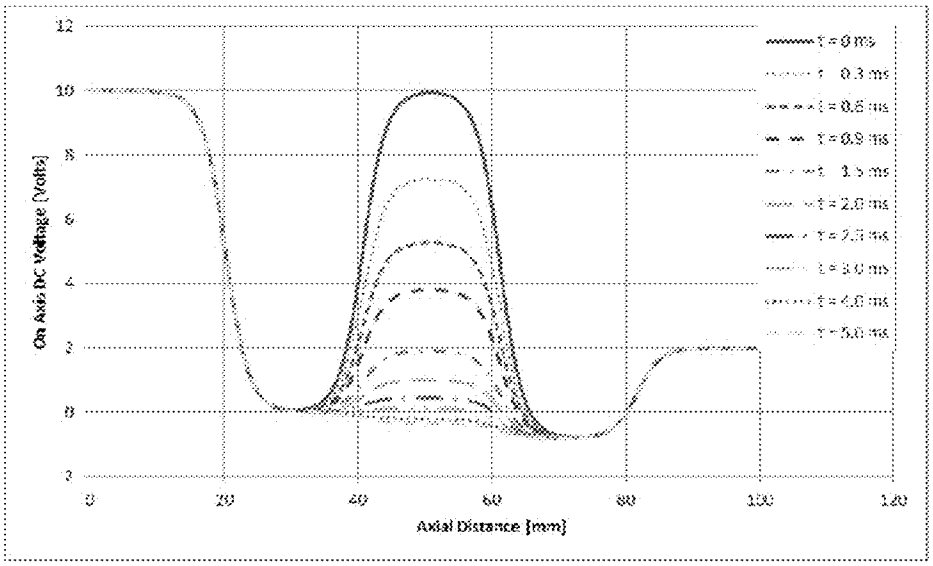

FIG. 15 shows axial DC offset voltage profiles along the segmented ion guide plotted at several times following the onset of a DC voltage change when using the natural RC time-constant response.

Figure 16:
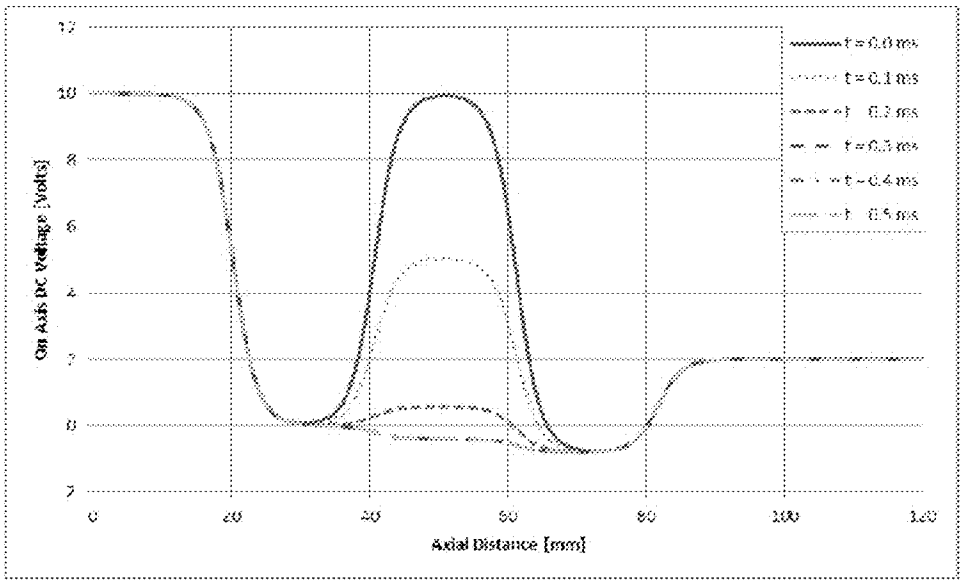

FIG. 16 shows axial DC profiles along the segmented ion guide plotted at several times following the onset of a DC voltage change when using an example method.

Figure 17:
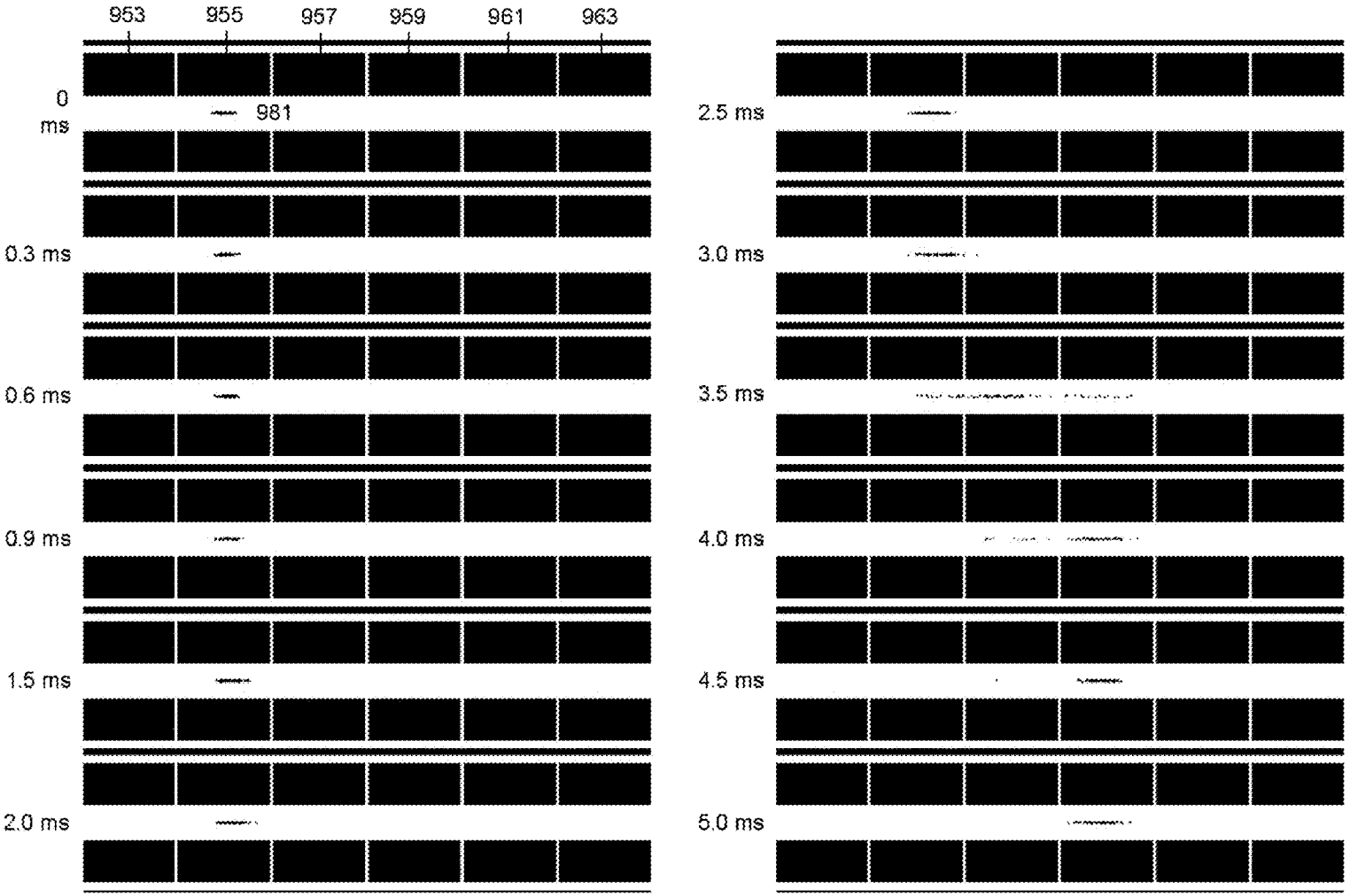

FIG. 17 shows simulation screenshots showing ion positions at several times after the onset of DC offset voltage switching when using the natural RC time-constant response.

Figure 18:
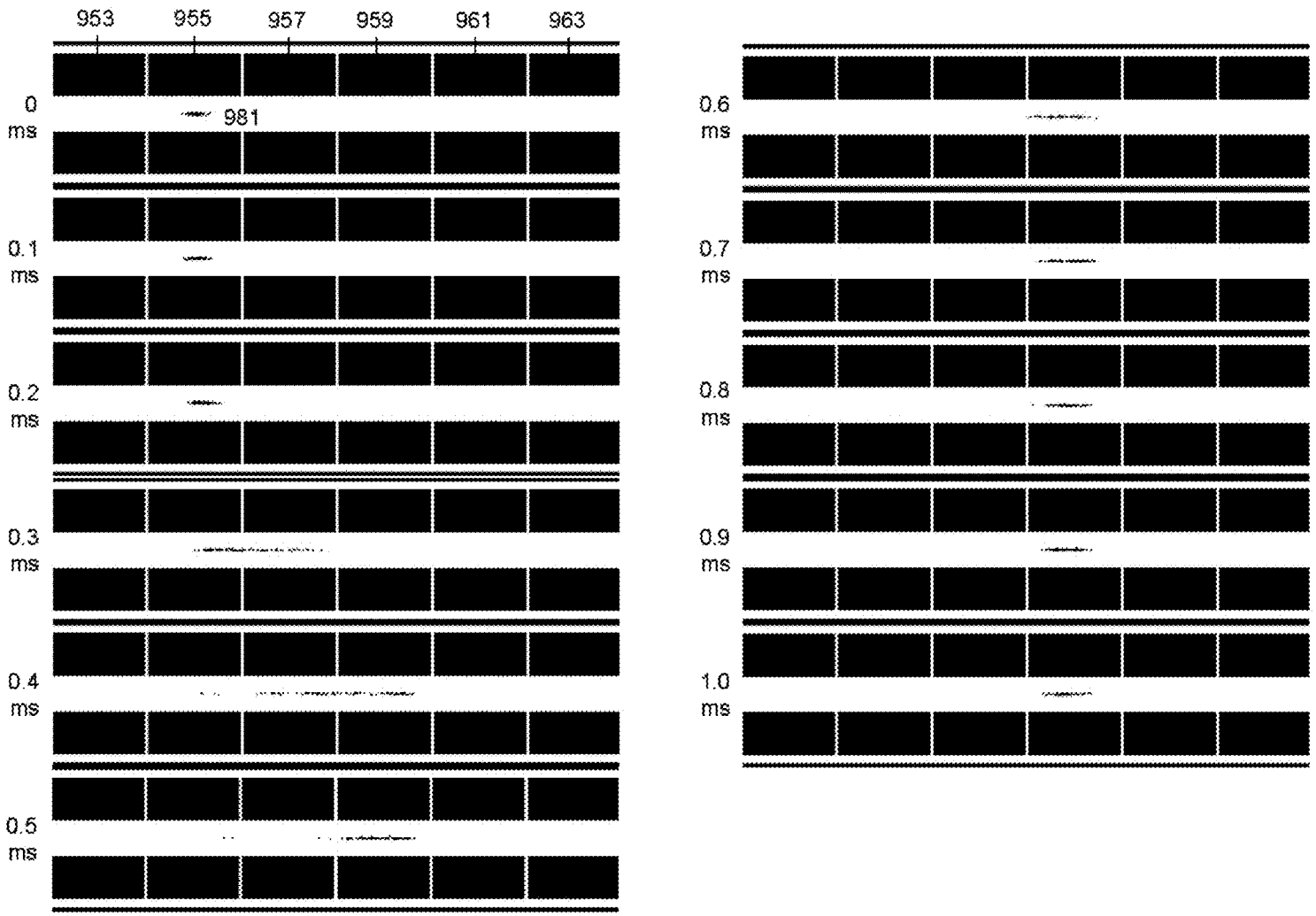

FIG. 18 shows simulation screenshots showing ion positions at several times after the onset of DC offset voltage switching when using a preferred method.

Figure 19:
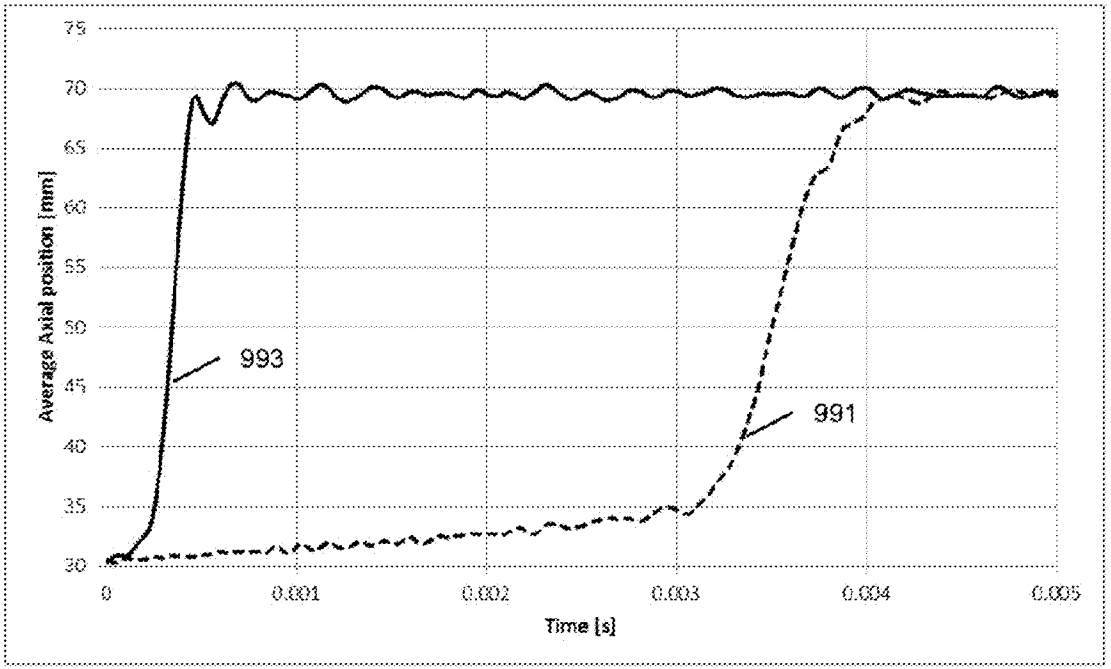

FIG. 19 is a plot showing the average axial position of bunches of 100 ions with time. The dashed line shows the result when using the standard RC time constant response. The solid line shows the result when using the current invention to change the DC offset voltage.

In mass spectrometers, it is common for DC offset voltages to be applied to ion optical components via an RC ("resistor and capacitor") network that includes at least one resistance and at least one capacitance.

As discussed in more detail below, an RC network is typically associated with an RC time constant. Where different components have different RC time constants, it may take different amounts of time to change the DC offset voltage at the component from one level to another.

In some mass spectrometers, e.g. ion trap mass spectrometers operating at high scan speeds (e.g. US2010/0072362), it may be desirable to change the DC offset voltage at the ion optical component in as short a time as possible, e.g. so as to maximise the repetition rate of the instrument. For example, when operating at 200 Hz, there will in general be 5 ms available per repetition in which to perform ion processing. If relying on the natural time constants of the RC components, a large proportion of this time (say 3 ms) could be taken up waiting for DC offsets to change at the ion optical components.

In some mass spectrometers, it may be desirable for multiple DC offsets at multiple ion optical components to be changed at the same time.

The methods described herein may, in some embodiments, use one or more computer controllable DC power supplies to produce an overdrive DC offset voltage that is applied to an ion optical component via an RC network for a predetermined (e.g. calculated) period of time, e.g. to achieve a speed-up in a change of one or more DC offset voltages at one or more ion optical components. By applying an overdrive DC offset voltage for the predetermined period of time, the DC offset voltage at the ion optical component (s) can be changed in a much shorter time compared to relying on the natural RC response of the system. By applying a maximum available DC offset voltage for a predetermined (e.g. calculated) period of time, the DC offset value can be changed in as short a time as possible.

The methods described below may therefore provide an advantage of being able to change the DC offset voltage at one or more ion optical components far more quickly than would be possible without using these methods, thus potentially improving the duty cycle and repetition rate of a mass spectrometer. These methods might equally be applicable to any ion optical instrument which couples DC offsets to AC voltage waveforms (e.g. RF voltages) in a similar way.

The invention may be applicable equally to all forms of AC (e.g. RF) voltage waveform. Note that in all embodiments discussed herein, the AC (e.g. RF) voltage waveform might be sinusoidal in shape, a square wave (or digital) waveform, or other waveform shapes such as sawtooth etc.

Figure 1:
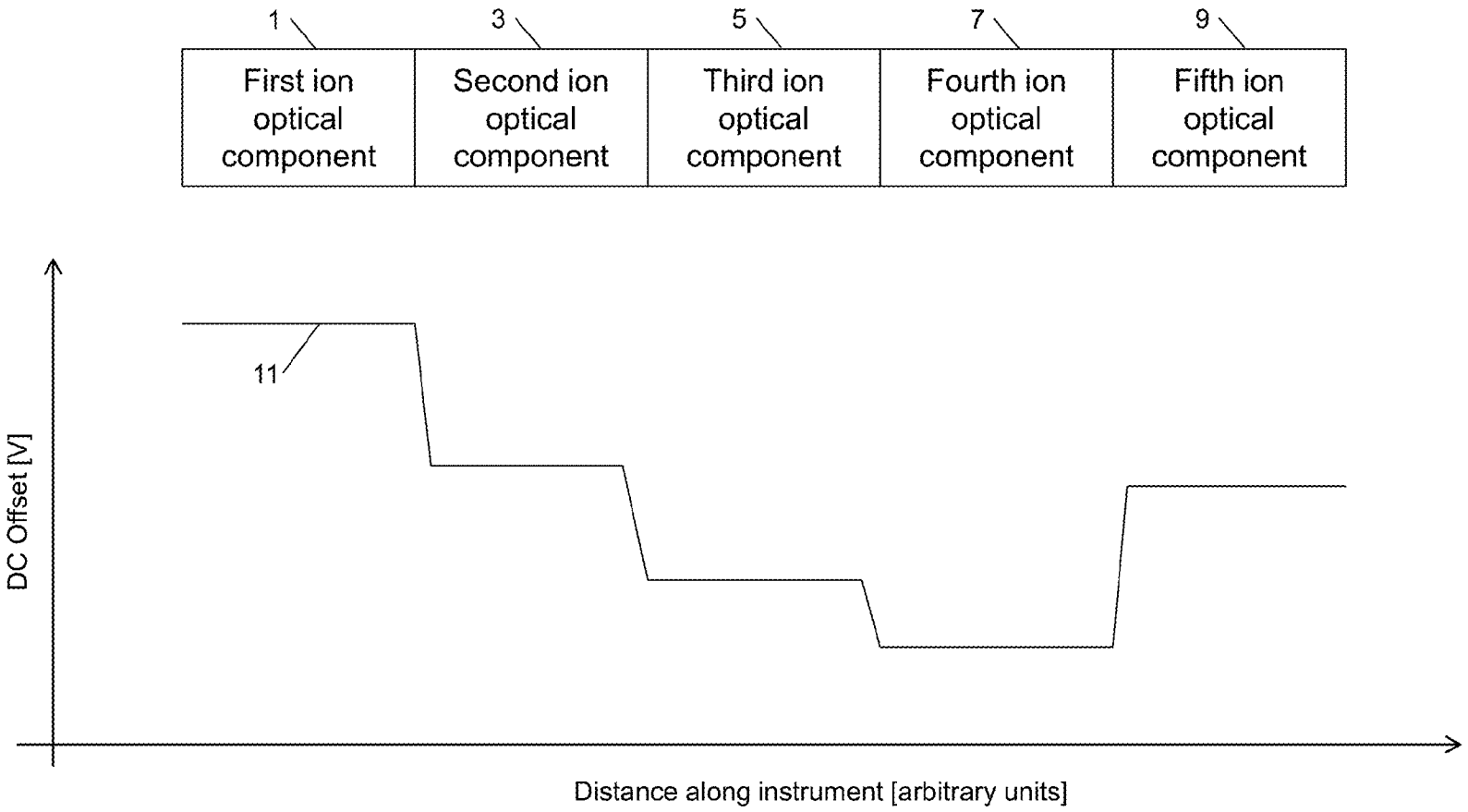
FIG. 1 shows a DC offset voltage profile.
Figure 2:
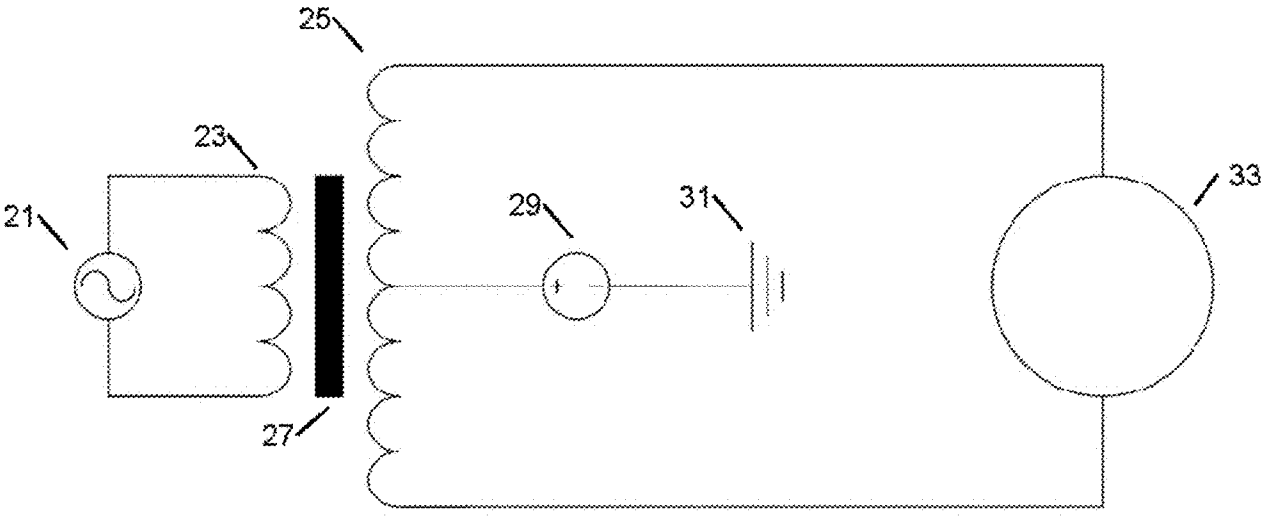
FIG. 2 shows an RF generator with centre tapped transformer.

One method to apply a common DC offset voltage to all ion optical elements to which a common AC voltage waveform is applied, is to apply the common DC offset voltage to the centre tap of a transformer of an RF generator which is being used to generate the AC voltage waveform. Such a circuit for achieving this is shown in FIG. 2. FIG. 2 shows an AC power supply (drive source) 21, a transformer with a single primary 23 and a split secondary 25. In this case the transformer is shown with a ferrite core 27, but the core could equally be air cored or any other suitable material. A DC offset voltage (which may be positive or negative) is produced by a DC power supply 29 and applied to the centre tap of the transformer. The AC voltage waveform with superimposed DC offset voltage may then be applied to the ion optical component 33. It could also be stated that the output AC voltage waveform is 'floated' at the value of the DC offset voltage applied to the centre tap. In this case, all ion optical elements to which this AC voltage is applied would also have the same DC voltage applied. An exception is where a capacitor is used to block/remove the DC offset applied to the centre tap.

Figure 3:
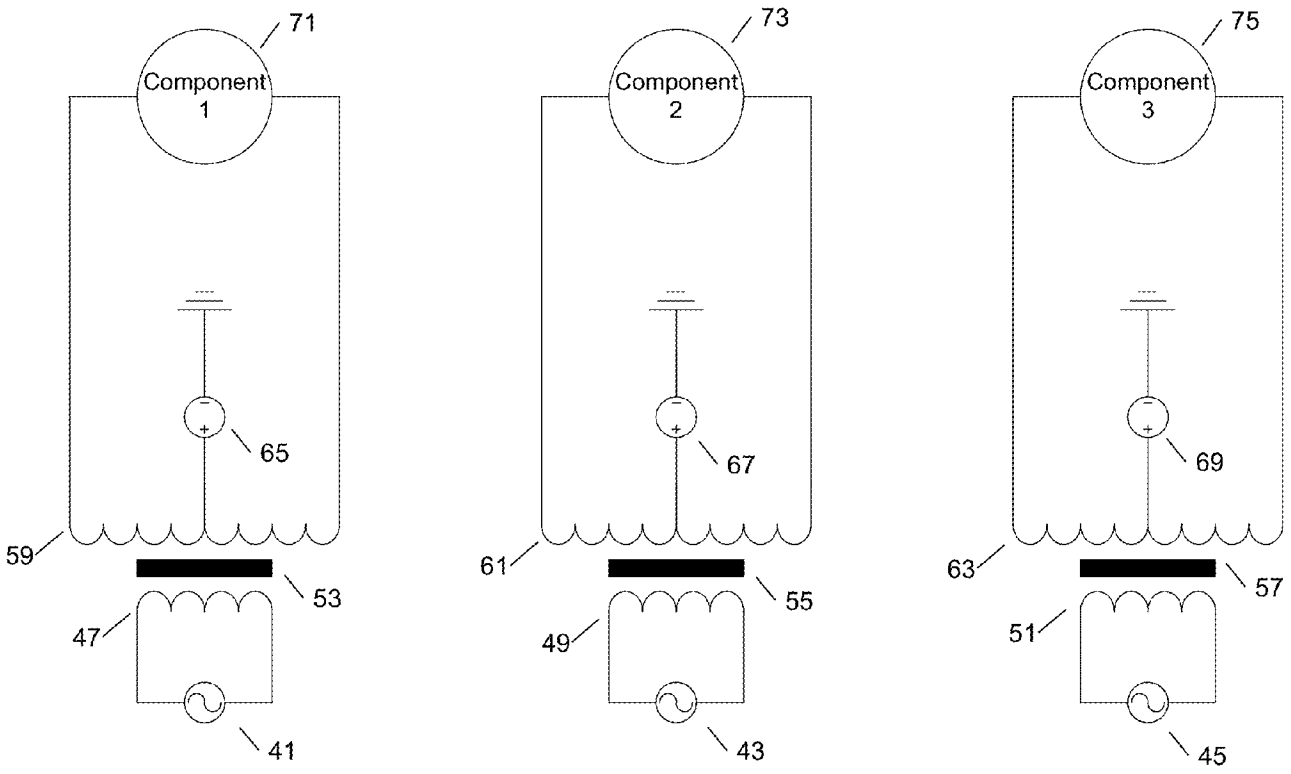
FIG. 3 shows several DC offset voltages applied with several RF generators.

FIG. 3 shows a case where several DC offsets are applied to several different ion optical elements which each have an independent AC power supply (voltage generator). Several AC power supplies (drive sources) 41, 43, 45 are applied to three separate primary windings 47, 49, 51. Three separate secondary windings 59, 61, 63 each receive a DC offset voltage applied by a separate, respective, DC power supply 65, 67, 69. The output of each AC power supply (in this case an RF generator) is applied, respectively, to three separate ion optical components 71, 73, 75. In this case, different AC power supplies are used for each ion optical component, each of which has its own DC offset voltage applied to it. Such an arrangement could be viewed as overly complicated in cases where several elements are to have similar AC voltages waveforms applied thereto (for example, the same voltage and frequency might be applied to several components).

Figure 4:
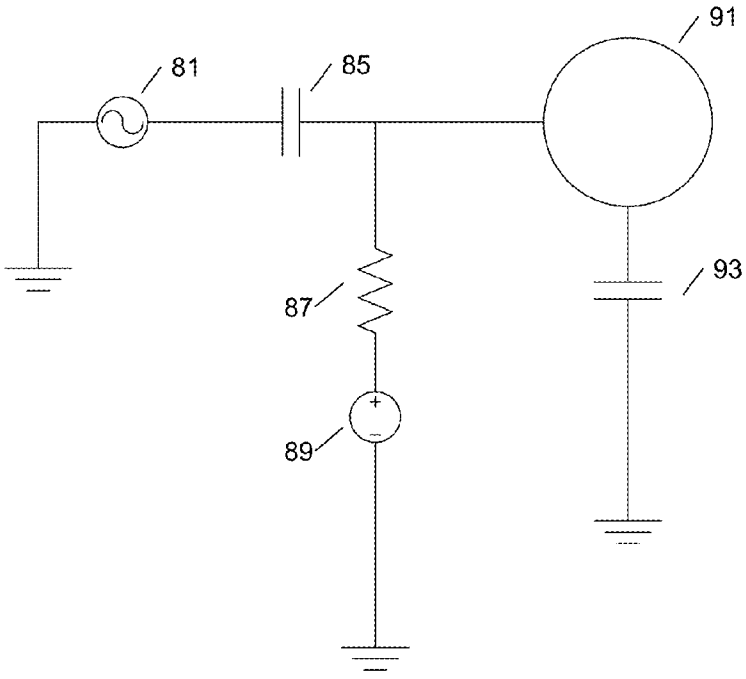
FIG. 4 shows an example RC network used to apply DC offset voltage to an ion optical component.

A potentially improved situation can be obtained in cases where it is desired to apply a different DC offset voltage to ion optical components receiving the same AC voltage waveform, by taking the AC voltage waveform and applying a different DC offset voltage to each segment by way of a circuit such as that shown in FIG. 4. This figure gives a schematic circuit diagram for application of a DC offset by way of an RC network including a resistor and a capacitor. The AC (e.g. RF) voltage waveform 81 is applied with reference to a reference potential (e.g. ground). This AC is applied via the RC network through a capacitor 85. A DC offset voltage 89 which is produced with reference to a reference potential (e.g. ground), which may or may not be the same reference potential as used by the AC voltage waveform, is applied to the ion optical component 91 via the RC network through a resistor 87. There is normally an associated parasitic capacitance 93 between the ion optical element and ground (often due to the ion optical component being maintained in a grounded vacuum chamber or through capacitances between PCB tracks or wiring to ground). The capacitor 85 is therefore often chosen to be considerably larger than the parasitic capacitances 93 to allow a well-defined capacitance for the RC network (that is, the capacitor 93 is often chosen to 'swamp' the natural capacitance to ground of the ion optical element) as well as to minimise division of the AC drive waveform as a consequence of the capacitive divider effect.

Figure 5:
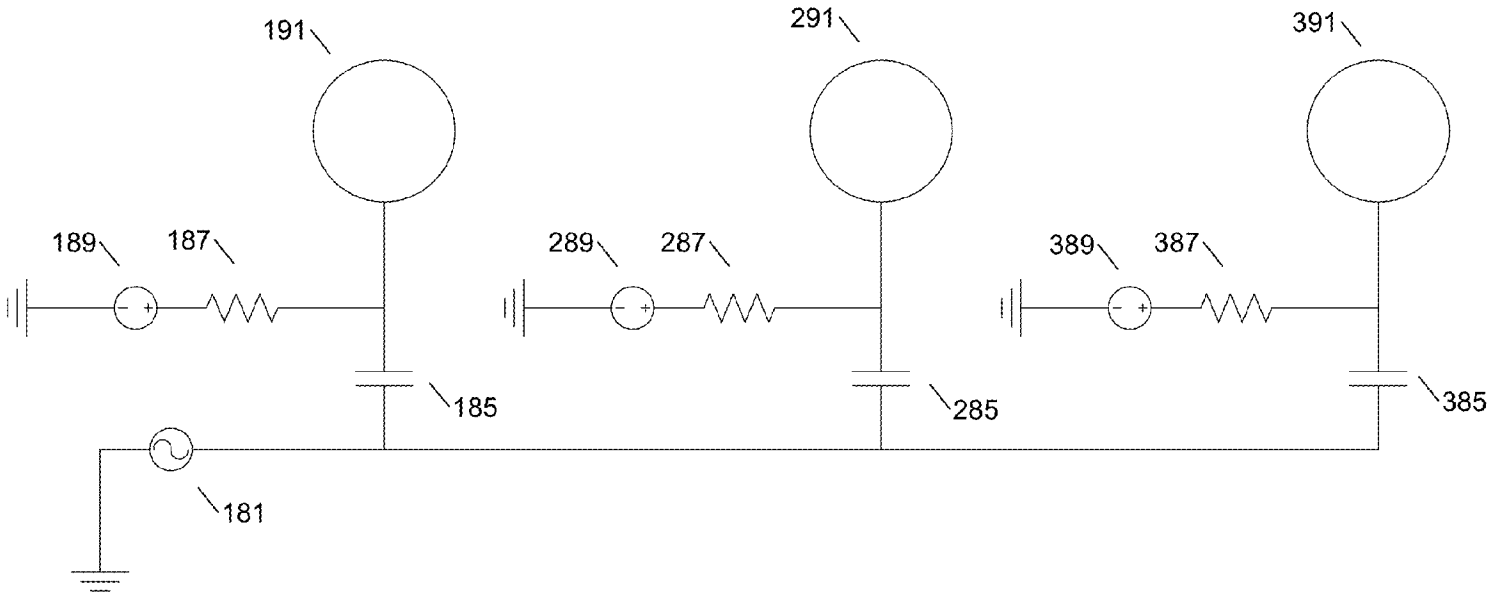
FIG. 5 shows several DC offset voltages applied with the same RF generator and different RC networks.

In circumstances where the same AC voltage waveform is to be applied to several ion optical components, but different DC offset voltages are required on each component, the circuit might be employed in a manner such as that shown in FIG. 5. Here, the AC (e.g. RF) voltage waveform 181 is applied with reference to ground or a fixed reference potential. This same AC voltage waveform is applied to each ion optical component 191, 291 and 391, respectively, via three RC networks that each incorporate a separate capacitor 185, 285 and 385. Three separate DC offset voltages 189, 289, 389 (which may be positive or negative) are applied, respectively, to the optical components, through the RC networks via associated resistors 187, 287 and 387.

Such a circuit as shown in FIG. 4 constitutes a basic resistor-capacitor ("RC") network as is very well known in the field of electronics. See for example, Horowitz and Hill, "The Art of Electronics" second edition page 23, which describes the properties of such an RC network. Herein, the terms "RC network" and "RC circuit" may be used interchangeably. When charging a capacitor through a resistor as is being performed in FIG. 4, the resistor limits the current flow, leading to a well characterised time to charge the capacitor. The standard equation for a circuit such as that shown in FIG. 4 is:

$$I=(V_{app}-V)/R \quad \text{[Equation 1]}$$

Where I represents the current, $V_{app}$ represents the DC offset voltage applied to the ion optical component via the RC network including the resistor of value R, and V represents the current voltage applied at the ion optical component (i.e. the voltage currently applied to the ion optical element). Knowing also that:

$$I=C(dV/dt) \quad \text{[Equation 2]}$$

where C represents the value of the capacitor used in the circuit, the expression $$C(dV/dt)=(V_{app}-V)/R \quad \text{[Equation 3]}$$

can be obtained. This is a differential equation which can be solved simply to obtain the expression $$V=V_{app}(1-e^{-t/RC}) \quad \text{[Equation 4]}$$

The product RC is referred to as the time constant of the circuit. Equation 4 is a specific equation of the more general form $V=Ae^{-t/RC}$ where A can been calculated knowing the initial conditions $V_{app}$.

When R is expressed in ohms and C in farads, the product RC is in seconds. The RC time constant can be shown to be the time it takes to charge to ~63% of the final voltage. A 'rule of thumb' is that the capacitor will be charged to ~99% of its final voltage in around 5 time constants.

Consequently, the time to change the DC offset applied to an ion optical elements from one level to another can be easily calculated. Take as an example the case where the capacitor 85 in FIG. 4 has a value 1 nF and the resistor 87 1 Mohm. Assume that the capacitance 93 between the ion optical element and ground is 1 pF, hence its effect is negligible. Assume that the intention is to change a DC offset from 0 V to 100 V. The RC time constant can be easily calculated as $1\times10^{-3}$ seconds=1 millisecond. Hence we would expect the DC offset to have changed to ~99% of its target value of 100 V in 5 ms using the 'rule of thumb' stated above. Using Equation 4 above to plot the voltage over time we obtain the trace 501 shown in FIG. 6. It can be seen that the voltage does indeed reach ~99% of its target value at around 5 ms.

A possible route to speeding up this RC is to reduce the RC time constant. This might be achieved by either reducing the capacitance C, reducing the resistance R, or both. This is not always desirable however, as the capacitance is preferably chosen to be significantly larger than the parasitic capacitance between the ion optical element and ground in order that the applied AC is of the correct magnitude. This is a capacitive divider effect: should the capacitance C in the RC circuit be of approximately the same value as the parasitic capacitance between the ion optical element and ground for example, the applied AC would have approximately half the amplitude that was generated by the AC PSU. Take the example where there is 1 nF capacitance between the ion optical element and ground, and a 1 nF capacitor is also used in the RC circuit. If 100 V AC was applied to the circuit, the AC amplitude at the ion optical device would be only half (50 V) of that at the output of the AC generator. This is clearly undesirable as the AC PSU must work at higher voltage than would otherwise be necessary. For this reason, the capacitive element of the RC network is frequently chosen to 'swamp' the parasitic capacitance between the ion optical element and ground.

Equally, the resistive element of the RC network could be made smaller, but it is undesirable to do so. A smaller resistance used in the RC network has the effect of increasing the load on the AC PSU, increasing its power requirement. This is clearly undesirable, especially in the case where there are multiple ion optical elements supplied with the same AC waveform, the increased load on the AC PSU can be significant. It may also be said that this increased power would be dissipated (usually in the form of heat) in these resistors, and that there is a reasonable limit to the amount of power that it is desirable to dissipate in these resistors. Consequently, it is preferable to increase the resistance of the resistor R in the RC network to reduce power dissipation to an acceptable level.

Nonetheless, the skilled reader will recognise that, in general, it may be preferable to choose the capacitance and resistance in the RC network to values which produce an acceptable level of voltage drop at the ion optical element and minimise power dissipation whilst at the same time reducing the RC time constant as much as possible. The exact combination of values chose will depend on the application and what is acceptable to the user. The methods described herein are thought to apply equally to all RC networks regardless of whether they are suitably chosen to minimise the time constant. But it would nonetheless be desirable to first ensure that any RC network that is chosen is suitably optimised for the relevant application.

The methods described herein may be used to speed up one or more DC offset voltage changes at one or more components, and in some embodiments, to ensure that the change(s) is(are) achieved in a predetermined period of time. The ability to speed up the change(s) might be useful in circumstances where the DC offset voltages must be changed as quickly as possible for example. The ability to ensure the change(s) take(s) a predetermined period of time might be useful in circumstances where several components have different R or C values, hence possessing different RC time constants.

First, we take the case whereby it is desirable to change the DC offset voltage at an ion optical component between two values as quickly as possible. Here, this speed up may be achieved by dynamically changing the applied DC offset voltage to a maximum output voltage of the DC power supply for a predetermined time, before changing the DC offset voltage to a target value at the predetermined time. This predetermined time can be calculated as demonstrated below. In this way, the DC offset voltage at the ion optical component can be changed at a rate that is faster than the natural rate that would be obtained were the target DC offset voltage to be applied initially (i.e. at a rate that is faster than the natural RC response of the system).

In the descriptions herein the terms "target DC offset voltage" or "final DC offset voltage" may be used to mean the desired final DC offset voltage to be applied to a component via the RC network. This may be a positive or a negative voltage. In examples given here, the initial (or "start") DC offset voltage may be taken as being 0 V, but it will be clear to the skilled practitioner that the initial DC offset voltage can be any voltage. In such a case, the Equations given here may be suitably modified to account for the appropriate initial DC offset voltage. In examples given here, the terms "overdrive DC offset voltage" or "overvoltage" will be used to define the DC offset voltage applied for some predetermined period of time to an ion optical component via an RC network, which is higher in magnitude than the target DC offset voltage (assuming the initial DC offset voltage is 0V), so as to speed up the transition at the ion optical component from the initial DC offset voltage to the target DC offset voltage. It should be recognised that this overdrive DC offset voltage may be positive or negative in sign, or zero, depending on the initial and target DC offset voltages.

Given the maximum possible overdrive DC offset voltage, it is possible to determine the time it would take the voltage at the ion optical component to rise to the target DC offset voltage and then to change the DC offset voltage applied to the component via the RC network to the target voltage at or at around this time.

For example, let $V_o$ equal the maximum possible overdrive DC offset voltage in this case and $V_t$ equal the target DC offset voltage. Given Equation 4 above we would like to calculate t knowing that $V_{app}=V_o$, $V=V_t$ and knowing also the time constant RC which may be calculated from the values of the components present or measured. Rearranging Equation 4 gives the expression $$V_t/V_o=1-e^{-t/RC} \quad \text{[Equation 5]}$$

This may be further rearranged to give the expression $$e^{-t/RC}=1-(V_t/V_o) \quad \text{[Equation 6]}$$

Taking the natural logarithm of each side:

$$\ln(e^{-t/RC})=\ln(1-(V_t/V_o))=-t/RC=\ln(1-(V_t/V_o)) \quad \text{[Equation 7]}$$

and then rearranging to make t the subject of the equation gives an expression for the time taken to reach the target voltage $V_f$ given an overdrive voltage $V_o$:

$$t=-RC\ln(1-(V_f/V_o)) \quad \text{[Equation 8]}$$

Figure 6:
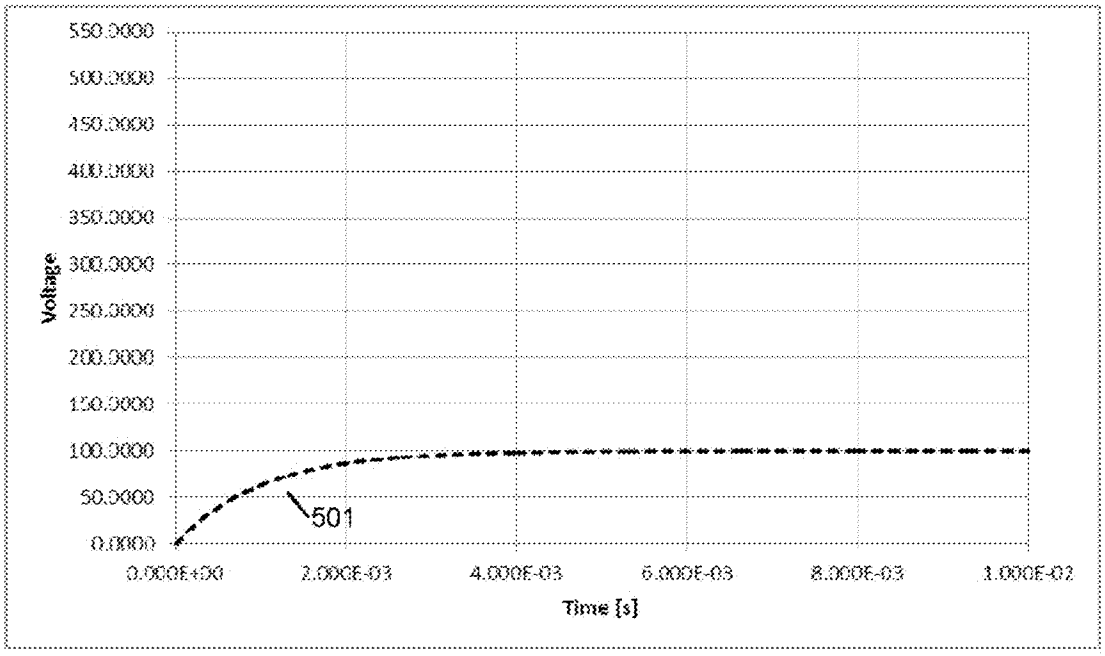
FIG. 6 shows a voltage profile for standard RC time constant.
Figure 7:
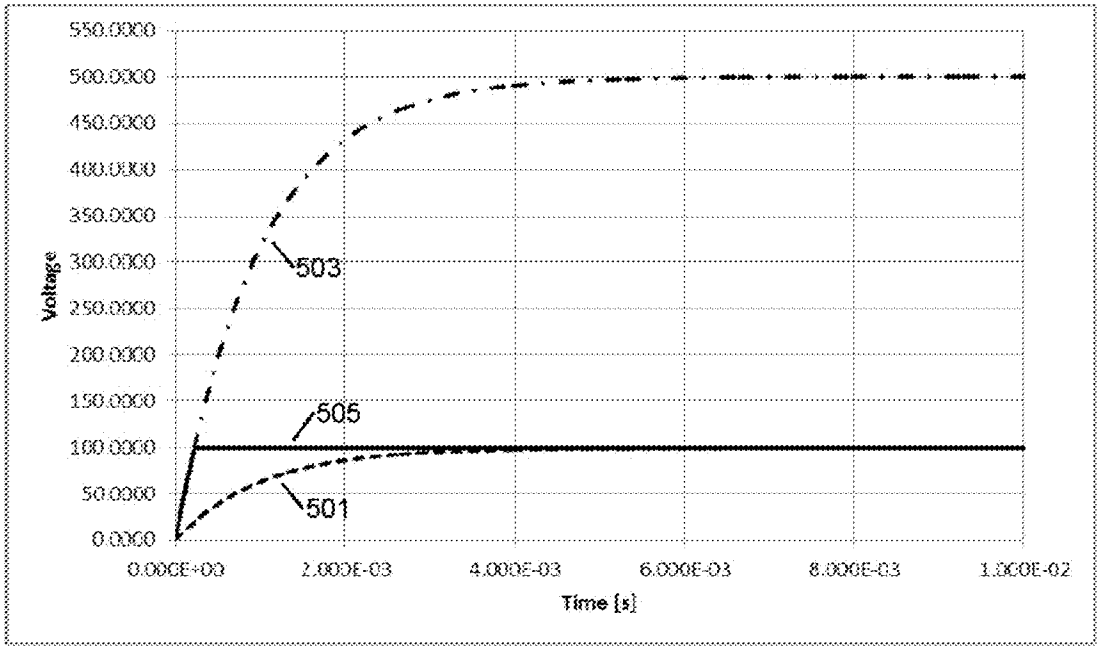
FIG. 7 shows a voltage profile when using an overdrive DC offset voltage for a predetermined period of time before switching to a target DC offset voltage.

With reference to the above example for a natural RC time constant, consider the following alternative method of driving the circuit. Assume that a maximum output voltage of the DC offset power supply was 500 V. The overdrive DC offset voltage $V_o$ could then be set to 500 V. The natural response of the circuit if a drive voltage of 100 V were used is shown in FIG. 6 by the dashed line 501. FIG. 7 shows both this natural response with a 100 V DC offset (dashed line 501) and the natural response if a 500 V DC were to be used (dash-dotted line 503). In both cases, the voltage would achieve ~99% of the final DC offset by around 5 RC time constants, in this case around 5 ms, if it were allowed sufficient time for the natural RC response. It can be seen however that the voltage rises more quickly when 500 V is applied than when 100 V is applied. FIG. 7 also shows the case where 500 V is applied for approximately 0.22 milliseconds before being switched to 100 V (solid black line 505). It can be seen that the final target DC offset voltage of 100 V at the component can be reached much more quickly in the case where the dynamic switching of the DC offset voltage is used than when it is not. Taking the 'rule of thumb' value of five times the time constant, the speedup can be seen to be ~22 times faster where the DC offset switching technique is used compared to when it is not used (natural RC time constant). The advantage of actively switching the applied DC as described here is immediately obvious.

Indeed, the speed up can be calculated as shown below. Consider the case where 99.9% of the final target voltage is taken as the point at which the transition can be considered completed (a more thorough statement than the 'rule of thumb' value used above). The time for the natural RC time constant limited transition can be calculated as $$t_{standard}=-RC\ln(1-0.999) \quad \text{[Equation 9]}$$

The time taken for the DC offset speed up technique has already been shown to be calculated by Equation 8. The ratio of Equation 9 over Equation 8 gives number of times improvement gained by using the DC offset speed up technique described herein as compared to using the standard RC method.

$$\begin{aligned} r_{speedup} &= -RC\ln(1-0.999)/-RC\ln(1-(V_t/V_o)) \quad \text{[Equation 10]} \\ &= -\ln(1-0.999)/-\ln(1-(V_t/V_o)) \\ &\approx 6.91/-\ln(1-(V_t/V_o)) \end{aligned}$$

It will be obvious to those skilled in the art that Equation 10 can be modified appropriately to calculate the speedup to reach any percentage value of the target voltage by replacing the value 0.999 with the appropriate value. This percentage of the target value can be chosen appropriately according to the user who can determine an appropriate percentage based on the requirements of the application.

Figure 8:
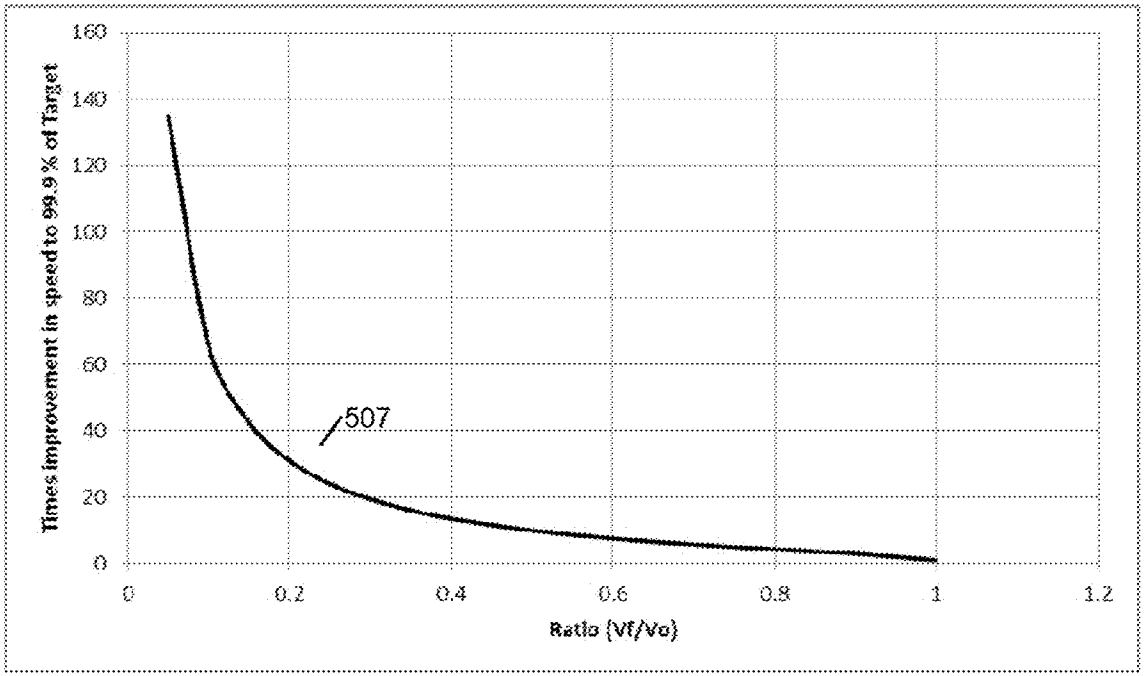
FIG. 8 shows an improvement in DC offset voltage change time plotted against the ratio of target DC offset voltage over overdrive DC offset voltage.

Using the example above, the DC offset speed up method can be calculated to offer a 30.96 times advantage over using the standard method to reach 99.9% of the target voltage, agreeing with the value calculated above by reading from FIG. 7. By defining the ratio of the target voltage over the overdrive voltage as $r=V_t/V_o$, the number of times improvement in DC offset change speed at the component can be plotted against the ratio. This is shown in FIG. 8 (507). It can be seen that a higher overdrive DC offset voltage for the same target DC offset voltage (lower r) gives rise to a significant improvement in DC bias change time. It should be considered however that there are likely to be limitations on how high a voltage can practically be used for the DC offset power supply: component limitations, breakdown issues and the level of control which can be used for setting the target DC offset voltage all cause a compromise to be made. Conversely however, it can also be seen that even a modest increase in overdrive DC offset voltage can lead to several times shorter DC bias changes at the ion optical element.

Figure 9:
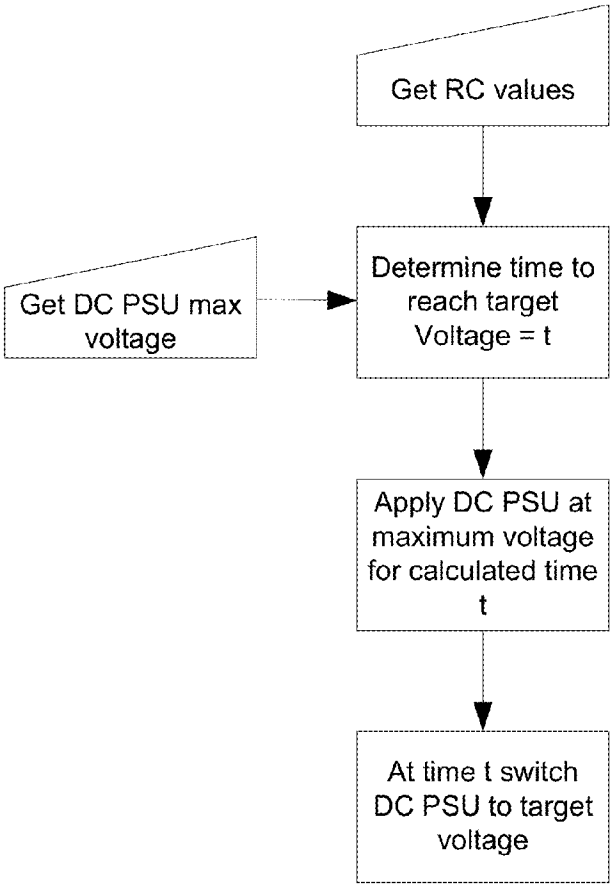
FIG. 9 shows an example flow diagram for maximum speed up.

An example flow diagram for changing the DC offset voltage at the ion optical component in as short a time as possible is shown in FIG. 9.

Second, we take the case whereby it is desirable to change the DC offset voltage at an ion optical component in a predetermined period of time (i.e. so not necessarily as quickly as possible).

Such an approach could be useful (as described previously) where multiple DC offset voltages at multiple ion optical components are being changed at the same time via RC networks having different RC time constants, yet it is desirable that all DC offset changes are completed approximately simultaneously. In this case, the overdrive DC voltage to be applied to each ion optical component via a respective RC network needs to be determined for the same transition time. In the same way as shown previously, each DC voltage applied to a respective ion optical component via a respective RC network is at a respective overdrive DC offset voltage for a predetermined period of time, before the DC offset voltage is dynamically switched to a respective target DC offset voltage.

In this case, an overdrive DC offset voltage ("overdrive voltage") $V_o$ that achieves a voltage at the ion optical component that is at a target DC offset voltage $V_t$ at a given time t can be calculated using the following equation, that is easily derived from equation 4 (by setting $V_{app}=V_o$, $V=V_t$):

$$V_o=V_t/1-e^{-t/RC} \quad \text{[Equation 11]}$$

Using this equation, it is possible to calculate the overdrive DC offset voltage $V_o$ such that the DC offset voltage at an ion optical component is at the target DC offset voltage $V_t$ at a predetermined time t.

In the case where there are a plurality of DC power supplies, with each DC power supply corresponding to a respective ion optical component, then for each DC power supply, respectively, equation 11 may be used to calculate an overdrive DC offset voltage such that the DC offset at the component corresponding to the DC power supply is at the target voltage at the end of the same predetermined period of time, even if the DC power supplies are connected to their ion optical components via RC networks having different resistances and/or capacitances.

In other words, equation 11 can be used to calculate overdrive DC offset voltages so that the DC offset voltages at different ion optical elements can be switched to different target DC offset voltages at the same predetermined period of time, even if the DC power supplies used are connected to their ion optical components via RC networks having electronic components giving different time constants.

Figure 10:
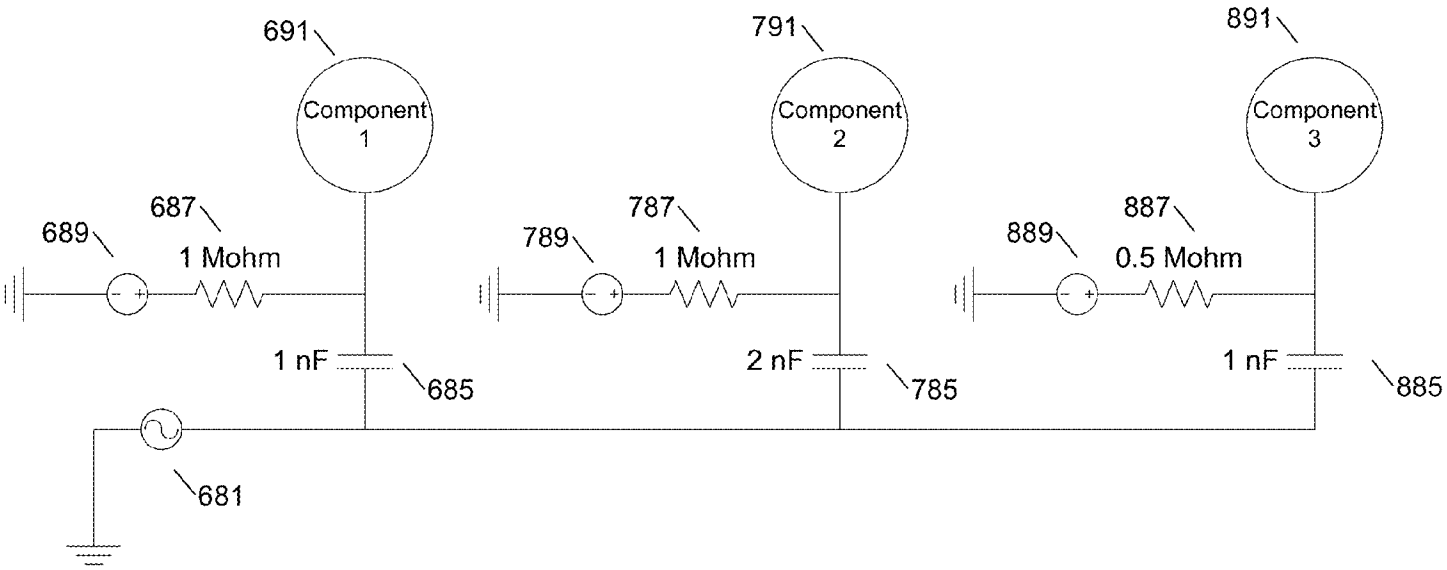
FIG. 10 shows multiple components with different time constants.

An example is given herein to illustrate this concept. Consider the circuit given in FIG. 10. Here, an AC (e.g. RF) voltage waveform 681 is applied with reference to a ground. This waveform is applied via three separate RC networks (each including a respective capacitor 685, 785, 885) to a respective ion optical component 691, 791, 891. Three separate DC offset voltages 689, 789, 889 (which may be positive or negative) are applied via the separate RC networks through associated resistors 687, 787, 887.

In this circuit, each ion optical component has a different combination of resistors and capacitors, leading to three different time constants of $1\times10^{-3}$ seconds for Component 1 (691), $2\times10^{-3}$ seconds for Component 2 (791) and $5\times10^{-4}$ seconds for Component 3 (891). Note that in FIG. 10, the parasitic capacitance of each ion optical component to ground is ignored as it is assumed to be insignificantly small.

Figure 11:
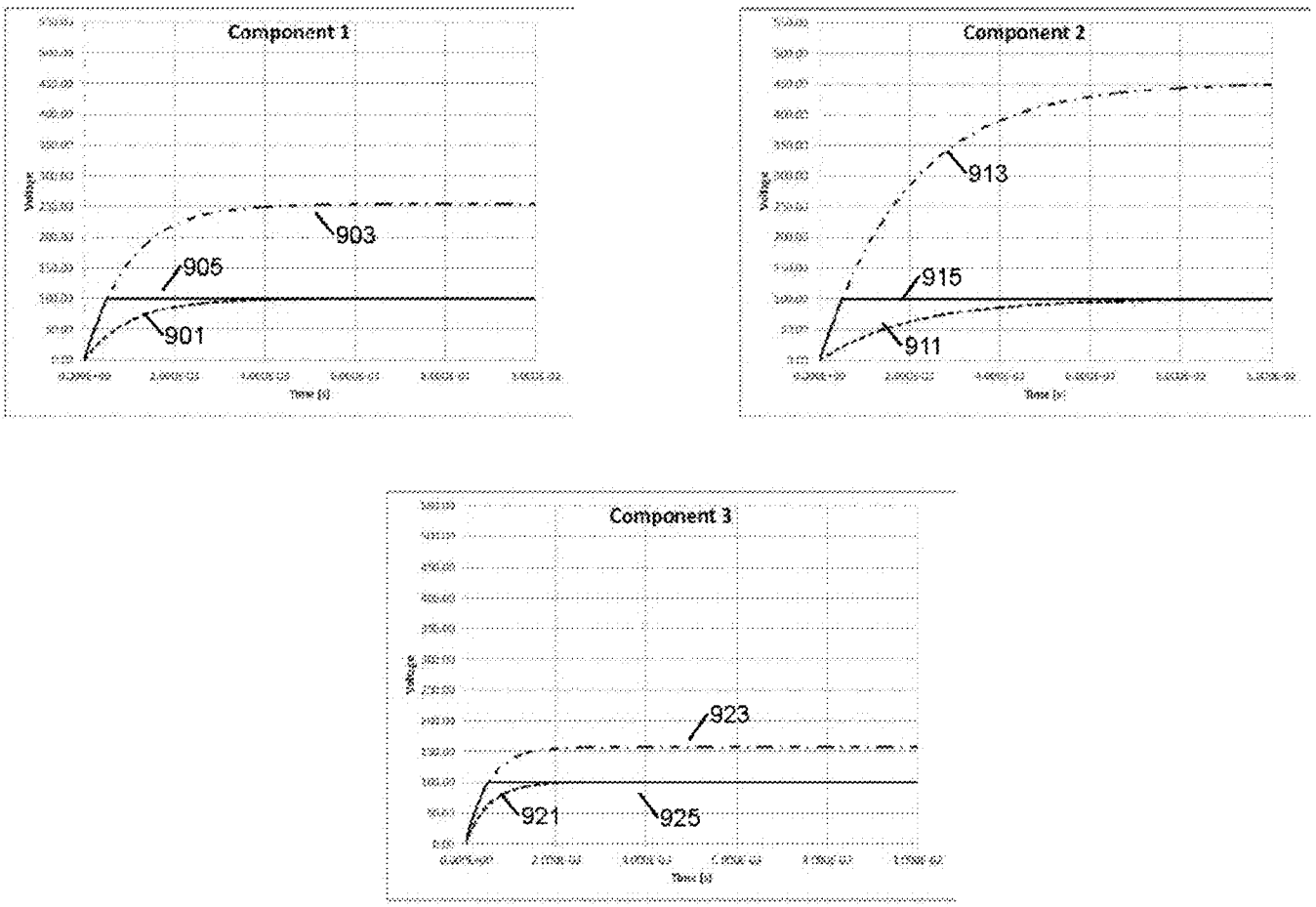
FIG. 11 shows curves for three different ion optical components with different time constants.

If the DC offset voltages produced by the DC power supplies were all changed from an initial DC offset voltage of 0V to a target DC offset voltage of, say, 100 V, there would be a large discrepancy in the time taken to reach 99.9% of the target DC offset voltage at each ion optical component. The minimum time in which the DC offset voltages at all components could be changed to the target DC offset voltage would be limited by the slowest time constant (i.e. component 2). Using the method described above with reference to equation 11, however, it is possible to set a target transition time $t_{target}$ and have all three components change their DC offsets in that time, by calculating appropriate overdrive DC offset voltages for each DC power supply. For example, if we assume a target transition time of 0.5 ms, and apply the requisite overdrive DC offset voltages for each DC power supply for 0.5 ms as calculated using equation 11 above, then all transitions can be completed within 0.5 ms. The overdrive DC voltages for this example would be 254.1 V for component 1 (691), 452.1 V for component 2 (791) and 158.2 V for component 3 (891). The voltage curves which would be obtained during these transitions are shown in FIG. 11.

For component 1 (691) (given the RC components used): the "standard" response when the DC power supply is controlled to produce the target DC offset voltage is shown as a dashed line 901, the "overdrive" response when the DC power supply is controlled to produce the overdrive DC voltage calculated as above (254.1V) is shown as a dashed-dotted line (903), and the "final" response achieved by controlling the DC power supply to produce the overdrive DC voltage calculated as above (254.1 V) for the predetermined target transition time $t_{target}$ and then (with little or no time gap) controlling the DC power supply to produce the target DC offset voltage is shown with a solid line 905.

For component 2 (791) (given the RC components used): the "standard" response when the DC power supply is controlled to produce the target DC offset voltage is shown as a dashed line 911, the "overdrive" response when the DC power supply is controlled to produce the overdrive DC voltage calculated as above (452.1V) is shown as a dashed-dotted line (913), and the "final" response achieved by controlling the DC power supply to produce the overdrive DC voltage calculated as above (452.1 V) for the predetermined target transition time $t_{target}$ and then (with little or no time gap) controlling the DC power supply to produce the target DC offset voltage is shown with a solid line 915.

For component 3 (891) (given the RC components used): the "standard" response when the DC power supply is controlled to produce the target DC offset voltage is shown as a dashed line 921, the "overdrive" response when the DC power supply is controlled to produce the overdrive DC voltage calculated as above (158.2V) is shown as a dashed-dotted line (923), and the "final" response achieved by controlling the DC power supply to produce the overdrive DC voltage calculated as above (158.2V) for the predetermined target transition time $t_{target}$ and then (with little or no time gap) controlling the DC power supply to produce the target DC offset voltage is shown with a solid line 925.

Note that the shortest possible transition time is limited by the maximum overdrive voltage (for the slowest time constant) achievable by the DC power supplies, and the longest possible transition time is determined by the natural response of the fastest time constant RC.

Figure 12:
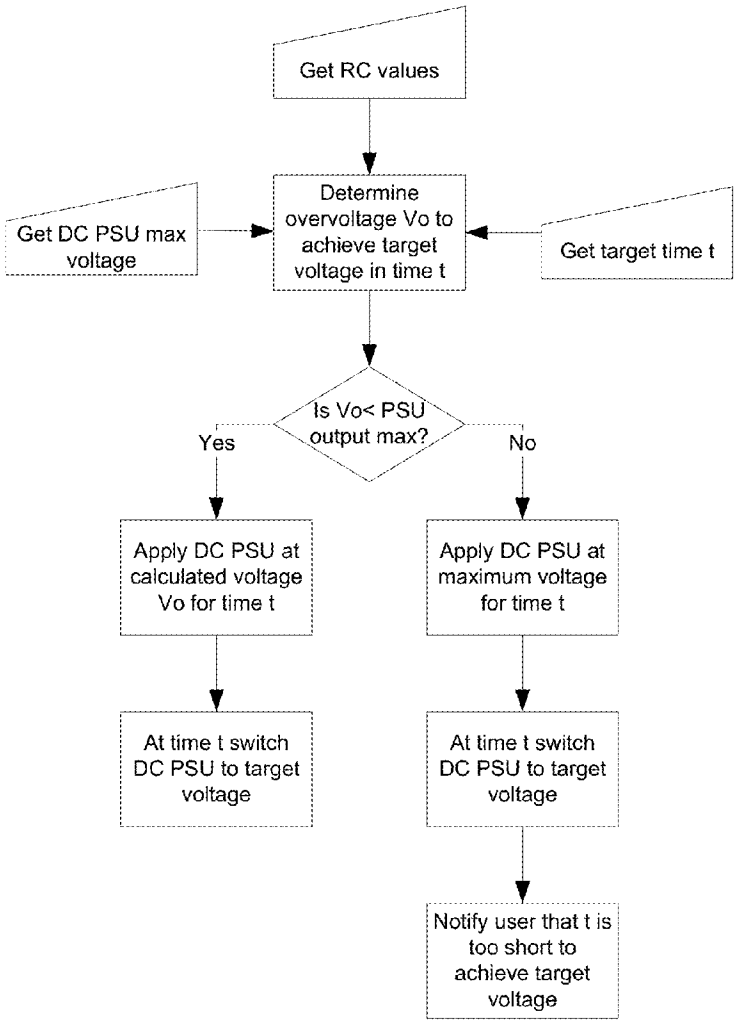
FIG. 12 shows an example flow diagram for changing in set time.

An example flow diagram for changing the DC offset voltage at an ion optical component at a predetermined target time t is shown in FIG. 12. Note that this is an example flow diagram only, and that other processes can easily be envisaged.

Note that the decision of what operations to perform if it is determined that the overdrive DC offset voltage ($V_o$) required to achieve the voltage transition in the target time t is greater than a maximum output of the DC power supply will in general depend on the requirements of the user and the specific application in question. In this particular example workflow, the operations performed upon this determination being made include selecting the overdrive DC offset voltage to be the maximum output of the DC power supply and issuing a warning notification.

A method as described above may be viewed as a method for accelerating DC bias level changes.

A method as described above may be used in the application of DC biases to components of a mass spectrometer (e.g. ion optical components, which could take the form of lenses, RF ion guides, mass filters etc., which may make up the ion optics of a mass spectrometer). As noted above, DC biases may be applied to ion optical components of a mass spectrometer in order to generate a desired DC profile along the device. These DC biases are frequently changed over time to change the DC profile in the mass spectrometer. In some cases it is desirable to have this process happen as quickly as possible (in cases where time is critical). In some cases, it is desirable to have all DC biases (which might have different resistors and capacitors and hence have different RC time constants) achieve their change in DC bias level in the same defined time.

The inventors can see no reason why the method described above cannot be applied to RC networks including any combination of resistors and capacitors (hence any time constant) given a sufficiently rapid computer control system and agile power supply. Nonetheless, it is likely in most cases that components will limit the methods to situations where PSUs can be used which have a maximum output of less than ~1 kV.

To achieve this voltage switching as described above (either to achieve maximum speed up or a fixed switching time) it is preferable to have:

- Knowledge of the resistors and capacitors used in the circuit coupling the DC to the ion optical components, or direct measurement or simulation of the RC time constant.
- A computer system to control the DC power supply or power supplies.
- A computer controllable DC power supply which has a voltage output which can be changed rapidly under computer control at a set time. Alternatively, a static DC power supply with voltage regulators to generate a variable voltage from the static high voltage supply. The maximum speed at which such a DC power supply can change voltage will provide a natural limit on performance of the system. For this reason, it is likely that a lower limit on the time taken to change voltage may be placed around 1 microseconds (the time taken for a very agile PSU to change voltage, based on current state of the art). However, it would also be possible to switch between two individual DC power supplies which together can be viewed as providing a single variable DC power supply, in which case this transition could be completed in nanoseconds.

Some advantages of the methods described above are:

- Considerable speed up of DC offset switching.
- Matched timing of DC offset switching for multiple ion optical components with different inherent time constants.
- No requirement for any additional power supplies, drives or components as it is likely that all components given herein are present in a typical mass spectrometry system already.
- Retaining the same DC offset switching time and allowing the use of higher value RC components in the DC offset switching circuit where that might be desirable.

Some known limitations of the methods described above are:

- The methods cannot be used to slow down a natural DC offset response to slower than the natural time to reach 99.9%. This is rarely a problem however.
- The maximum overdrive DC offset voltage which can be applied is likely to be limited by components or the ability to accurately set the voltage. Otherwise, a wide range of DC power supplies can be used.
- For a given overdrive DC offset voltage available to the user, there is a lower limit on the switching time which can be achieved by overdriving the system. A converse way of looking at this is that, for a voltage where the target DC offset voltage is already close to the maximum overdrive DC offset voltage that can be applied, the speed up will be relatively small.

Here are some possible modifications to the methods described above:

- The/each DC power supply could take various forms. For example, several power supplies could be used together to form a composite DC power supply. For example, one PSU floating on another. Or switching between two DC power supplies each set at a static voltage.
- Alternative methods of applying the offset voltage by other means, such as a divider network or other means.
- Additional capacitors or series/parallel combinations of capacitors to achieve a capacitance.
- Additional resistors or series/parallel combinations of resistors to achieve a resistance.

The methods described above may find use in any field where an AC voltage waveform and a DC offset voltage is applied simultaneously to one or more components. Outside of mass spectrometry, the methods may be used with devices for electron microscopy, ion transport, high energy physics etc.

The present invention may be implemented commercially as follows:

- In ion trap mass spectrometers having high scan speeds thereby necessitating fast DC offset transitions.
- These methods could be widely applied to a wide variety of mass spectrometry instruments to speed up DC offset transitions and consequently speed up analysis. This applies to MADLI instrumentation, ESI instrumentation (single quad, triple quads, IT-TOF), GC-MS instrumentation etc.
- There would be very little modification of most modern mass spectrometers required in order to apply the methods taught herein—it is likely to be a software only change. Hardware changes could include replacing DC offset PSUs with higher voltage alternatives to speed up the transition in cases where there is limited overdrive available when using the current PSUs.

Simulation Example

This section provides supporting information comparing the time to change DC bias levels using a current method used by the inventors and the improved methods described herein.

Figure 13:
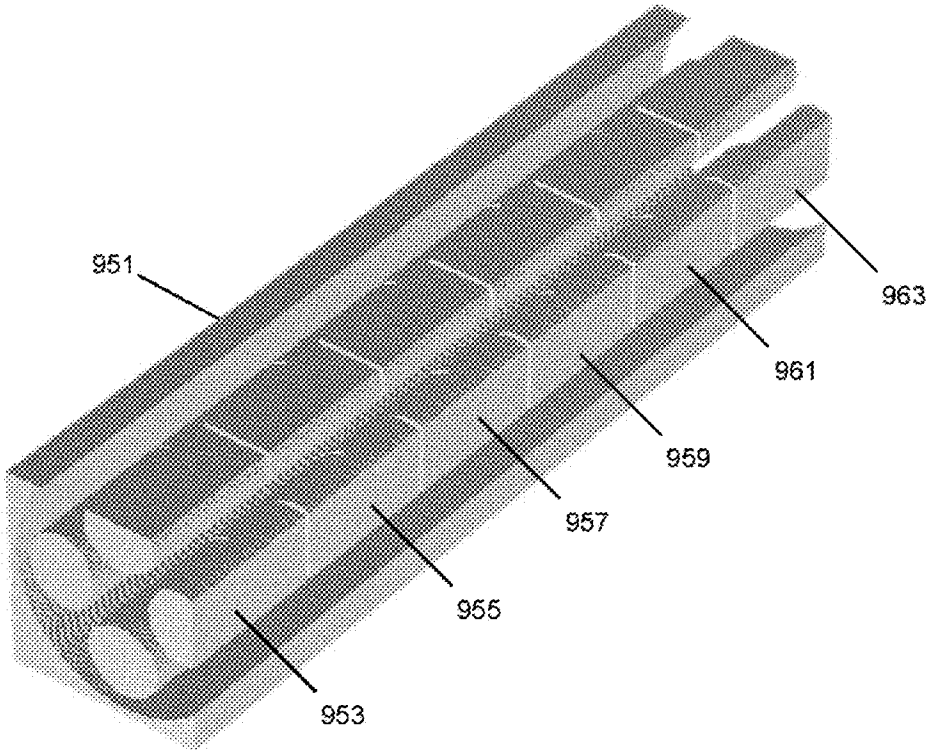
FIG. 13 shows a three dimensional model of an example electrode structure suitable for use with an example method.

An example is given herein to demonstrate the effectiveness of the presently disclosed methods in speeding up the transfer of ions within an ion optical system. The example chosen for this illustration is a segmented ion guide system shown in FIG. 13. The simple system consists of a segmented quadrupole device 951. Radiofrequency confining waveforms are applied to the rods in such a way as to generate a confining quadrupolar field. I.e. antiphase RF is applied to adjacent rods, with the same phase applied to opposite rods, as is well known in the art. A segment is defined here as a short section of, in this case, four rods to which the same DC offset voltage is applied. Each segment in this example is 20 mm in length, with a gap between segments of 0.5 mm. For example, the same DC offset voltage would be applied to all four rods of segment 1 (953). In this example, independent DC offset voltages are applied to each segment 953, 955, 957, 959, 961 and 963 to allow ions to be contained within the ion guide and transferred between segments. The application of different DC offset voltage to each segment allows the user to generate a desired DC profile along the device, also termed an axial DC profile.

In this example, the values of R and C are taken to be R=1 Mohm and C=1 nF, and all segments are assumed to use the same R and C values. The maximum overdrive voltage is assumed to be +/−42.5 V in this example (note that this is comparatively small, and in many circumstances, this overdrive voltage can be substantially higher). Ions simulated here are taken to be singly positively charged ions with m/z=609. The ion bunches in each case consist of 100 ions with suitable spatial and energy distributions as described below.

Take the example where a suitable DC profile is applied to the segmented ion guide such that ions are held trapped in segment 2 of the ion guide (955). DC offsets are applied to contain the ions axially. In this example, these DC offsets are taken to be Segment 1 (953)=10 V, Segment 2 (955)=0 V, Segment 3 (957)=10 V, Segment 4 (959)=−0.8 V, Segment 5 (961)=2 V and Segment 6 (963)=2 V. This creates a voltage profile suitable for trapping positive ions in Segment 2 of the device. Note also that ions could be trapped within Segment 4 at the outset, but it is assumed that no such ions are trapped here for this illustration. The ions held in Segment 2 are assumed to be in thermal equilibrium with a background buffer gas of Helium at a pressure of 10 mTorr and with temperature of 300 K. The ions might be described as "collisionally cooled". These conditions are simply used by way of illustration, and those skilled in the art will recognise that the temperature and pressure of any buffer gas present does not affect the outcome of the invention directly.

At a certain point, which we will define as $t_0$, the DC offset voltage applied to Segment 3 (957) will be changed to allow ions held in Segment 2 (955) to be transferred along the segmented quadrupole device into Segment 4, where they will be retained. The DC voltage applied to Segment 3 will be changed from its current state at $t_0$ (10 V) to a value of −0.4 V. Those skilled in the art will recognise that the new axial voltage profile along the segmented quadrupole will be suitable to transfer ions from Segment 2 (955) into Segment 4 (959), where they will be retained. Ion optical simulations are used here to illustrate two possibilities: where the standard RC time constant is used, and where the current invention is applied.

If the DC offset voltage applied to Segment 3 is changed dynamically according to an RC time constant-limited method currently used by the inventors, the DC voltage applied to Segment 3 will change in time according to the dashed line in FIG. 14 (971). If the improved method disclosed herein is used, by way of application of a −42.5 V overdrive voltage for a calculated time (approximately 200 microseconds), the DC voltage applied to Segment 3 will change in time according to the solid line in FIG. 14 (973). These voltage profiles may be calculated using the equations disclosed above.

FIG. 15 plots the axial DC profile along the segmented ion guide at several points in time. The axial position along the length of the segmented ion guide is plotted on the horizontal axis, and the potential (voltage) at each axial position is plotted on the vertical axis. For ease of reference, Segment 1 is centred at 10 mm, Segment 2 is centred at 30.5 mm, Segment 3 is centred at 51 mm, Segment 4 is centred at 71.5 mm and Segment 5 is centred at 92 mm in this example. The development of the axial profile with time can be seen from the plot. The axial DC profile is plotted at several time points, shown with different dashed lines according to the legend in the plot. It can be seen that the DC barrier presented by Segment 3 remains above 0V for more than 3 milliseconds. The ions trapped in Segment 2 cannot pass out of Segment 2 until the DC barrier is approximately equal to or less than the DC offset of Segment 2. In fact, the thermal energy of some ions might be sufficient for them to overcome a small DC barrier, but this effect is inconsequential in this example.

An equivalent plot for the methods described herein is shown in FIG. 16. As for FIG. 15, the axial position along the length of the segmented ion guide is plotted on the horizontal axis, and the potential (voltage) at each axial position is plotted on the vertical axis. Again, Segment 1 is centred at 10 mm, Segment 2 is centred at 30.5 mm, Segment 3 is centred at 51 mm, Segment 4 is centred at 71.5 mm and Segment 5 is centred at 92 mm. With use of the DC offset switching methods described herein, the voltage profile can be seen to develop far more rapidly than the case where the standard RC time response is used. In FIG. 16, the DC profiles are plotted much more frequently than in FIG. 15 (every 0.1 ms as opposed to every 0.3 ms). It can be seen that the DC barrier is approximately equal to or less than the DC offset of Segment 2 at t<0.3 ms. It is obvious that this speed up will have a considerable impact on the transfer of ions from Segment 2 into Segment 4.

Ion optical simulations using these DC profiles were performed, the results of which are given in FIG. 17-FIG. 19. These ion optical simulations used FDM fields with the FDM grid arranged at a resolution of 0.1 mm per grid unit. An in-house simulation package was used to simulate ion trajectories using a fourth order Runge-Kutta integration method.

FIG. 17 shows twelve 'snapshots' of ions contained within the segmented ion guide. FIG. 17 shows the effect of ion optical simulations when using the standard RC time constant response to change the DC offset voltage applied to Segment 3 (as described above). Each snapshot shows a cross section of the device. The segments of the device (953, 955, 957, 959, 961 and 963) and the ion clouds (981) can be clearly seen. Segment 1 (953) is the leftmost segment in each snapshot. Segment 6 (963) is the rightmost segment in each snapshot. At t=0 ms, the ions can be seen to be trapped within Segment 2 (955). The ions can be seen to be held within Segment 2 for an extended period, and can be seen to start moving from Segment 2 into Segment 3 at around 3.0 ms. By 4.5 ms, the transfer is largely complete, and the transfer can be seen to be fully complete by 5.0 ms. At this point, all ions have been successfully transferred into Segment 4.

FIG. 18 shows the 'snapshots' for the case where the improved DC offset switching method is used. Again, each snapshot shows a cross section of the device, where the segments can be clearly seen. Segment 1 (953) is the leftmost segment in each snapshot. Segment 6 (963) is the rightmost segment in each snapshot. At t=0 ms, the ions can be seen to be trapped within Segment 2 (955). In FIG. 18, the snapshots are taken far more frequently than in FIG. 17 (every 0.1 ms). Ions can be seen to be held within Segment 2 until around 0.2 ms. After this, the ions can be seen to migrate towards Segment 4. The transfer of ions can be seen to be largely complete by 0.5 ms, and fully complete by 0.6 ms. The transfer of ions from Segment 2 to Segment 4 is completed considerably faster in the case where the DC offset switching method is used compared to the case where the standard RC time constant method is used (between around 8 and 10 times faster).

The simulation data presented in FIG. 17 and FIG. 18 can be shown effectively by way of a plot, as shown in FIG. 19. FIG. 19 plots the average axial position of the ion bunches used in the ion optical simulations with time. The dashed line 991 shows the case where the DC offset of Segment 3 is changed using the natural RC time constant response. The solid line 993 shows the case where the improved DC offset switching technique described herein is used instead. The simulated time in seconds is shown on the horizontal axis. The average (mean) axial position of the ion bunches within the segmented ion guide in millimeters is plotted on the vertical axis.

For the standard RC response method (dashed line 991) the average axial position is seen to slowly increase between t=0 ms and t=3 ms. This is due to the steadily decreasing DC offset voltage being applied to Segment 3, resulting in a shift of the ion cloud to a higher axial position (the axial profile experienced by the ions is becomes asymmetric, hence ions are shifted towards the far end of Segment 2). At around t=3 ms, the average axial position begins to change more rapidly. The average axial position of the ions corresponds to them being trapped in Segment 4 by shortly after 4 ms. Note that the ions are not trapped at the centre of Segment 4 (which would correspond to 71.5 mm) as the DC profile is again asymmetric, with 2 V applied to Segment 5 and 0.4 V applied to Segment 3 in the steady state.

For the improved DC offset voltage method (solid line 993), the average axial position is seen to slowly increase between t=0 ms and approximately t=0.2 ms. The average axial position of the ion cloud can be seen to increase rapidly between approximately t=0.2 ms and t=0.5 ms. At around t=0.5 ms, the average axial position of the ions corresponds to them being trapped in Segment 4. This is considerably faster than the transfer of ions using the standard RC time constant method. This simulation demonstrates the effectiveness of using the current invention for changing DC offset voltages in ion guides, and acts as an example to demonstrate how the current invention can be used to speed up ion transfer in ion optical systems.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The invention claimed is:

1. A method of controlling a plurality of DC power supplies to change a respective DC offset voltage applied to each of a plurality of components for manipulating charged particles, wherein each DC power supply corresponds to a respective component, and wherein the method includes, whilst the same AC voltage waveform is being applied to each of the components:

for each DC power supply, respectively:

controlling the DC power supply to produce an initial DC offset voltage that is applied to the component corresponding to the DC power supply via a link that causes the DC offset voltage at the component to lag behind the DC offset voltage produced by the DC power supply when the DC offset voltage produced by the DC power supply is changed; then controlling the DC power supply to produce an overdrive DC offset voltage that is applied to the component corresponding to the DC power supply via the link for a predetermined period of time; then, after the predetermined period of time has elapsed controlling the DC power supply to produce a target DC offset voltage that is applied to the component corresponding to the DC power supply via the link, wherein the target DC offset voltage is between the initial DC offset voltage and the overdrive DC offset voltage;

wherein the method includes, for each DC power supply, respectively:

choosing the overdrive DC offset voltage such that the DC offset voltage at the component corresponding to the DC power supply is at, or is within a predetermined threshold of, the target voltage at the end of the predetermined period of time, wherein the DC offset voltage at each of the plurality of components is made to reach a respective target DC offset voltage at the end of the same predetermined period of time.

2. A method as set out in claim 1, wherein the method includes a user selecting the predetermined period of time.

3. A method as set out in claim 1, wherein the method includes determining whether each chosen overdrive DC offset voltage is greater than a maximum output voltage of the DC power supply.

4. A method as set out in claim 1, wherein the/each link is an RC network that includes at least one resistance and at least one capacitance.

5. A method as set out in claim 1, wherein each DC power supply and each component for manipulating charged particles is included in a mass spectrometer.

6. A controller configured to control an apparatus including a plurality of DC power supplies to perform a method as set out in claim 1.

7. A non-transitory computer readable medium having computer executable instruction configured to cause a computer to control an apparatus including a plurality of DC power supplies to perform a method as set out claim 1.

8. A method as set out in claim 1, wherein the/each link is an LC network that includes at least one inductance and at least one capacitance.

9. A method as set out in claim 1, wherein each link is an RC network, and the links have different resistances and/or capacitances to each other.

10. A method as set out in claim 1, wherein the target DC offset voltages are different to each other.

* * * * *